US010035360B2

(12) United States Patent
Mezaki

(10) Patent No.: US 10,035,360 B2
(45) Date of Patent: Jul. 31, 2018

(54) PRINTER, PRINTING METHOD, AND NON-TRANSITORY RECORDING MEDIUM

(71) Applicant: Daisuke Mezaki, Kanagawa (JP)

(72) Inventor: Daisuke Mezaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/371,612

(22) Filed: Dec. 7, 2016

(65) Prior Publication Data

US 2017/0080720 A1 Mar. 23, 2017

Related U.S. Application Data

(63) Continuation of application No. 14/938,514, filed on Nov. 11, 2015, now Pat. No. 9,561,679.

(30) Foreign Application Priority Data

Dec. 2, 2014 (JP) ..... 2014-244100

(51) Int. Cl.
*B41J 11/00* (2006.01)
*B41J 2/21* (2006.01)
*B41M 7/00* (2006.01)

(52) U.S. Cl.
CPC ..... *B41J 11/002* (2013.01); *B41J 2/2114* (2013.01); *B41M 7/0081* (2013.01)

(58) Field of Classification Search
CPC ..... B41J 11/002; B41J 2/2114; B41J 11/0015; B41J 2/2107; B41M 7/0081
USPC ..... 347/9, 14, 37, 95, 98, 101, 102
See application file for complete search history.

(56) References Cited

U.S. PATENT DOCUMENTS

| | | | | |
|---|---|---|---|---|
| 9,561,679 | B2 * | 2/2017 | Mezaki | B41J 2/2114 |
| 2011/0267394 | A1 | 11/2011 | Ochiai et al. | |
| 2011/0310204 | A1 | 12/2011 | Ohnishi | |
| 2013/0222497 | A1 | 8/2013 | Nakano et al. | |
| 2015/0242726 | A1 | 8/2015 | Sohgawa et al. | |

(Continued)

FOREIGN PATENT DOCUMENTS

| | | | |
|---|---|---|---|
| JP | 2005-199602 | A | 7/2005 |
| JP | 2010-195002 | A | 9/2010 |
| JP | 2011-063016 | A | 3/2011 |

(Continued)

*Primary Examiner* — Jannelle M Lebron
(74) *Attorney, Agent, or Firm* — Harness, Dickey & Pierce, P.L.C.

(57) ABSTRACT

A printer including a first liquid discharger, a second liquid discharger, a curing unit, and a controller is provided. The first and second liquid dischargers discharge active-energy-ray-curable colored and transparent liquids, respectively. The curing unit emits an active energy ray. The controller causes the first liquid discharger to scan multiple times and discharge the colored liquid on a medium, causes the curing unit to cure the colored liquid on the medium after each scan of the first liquid discharger to print a colored image with the colored liquid on the medium, causes the second liquid discharger to discharge the transparent liquid on the colored image, causes the curing unit to cure the transparent liquid on the colored image to form a transparent layer on the colored image, and controls a thickness of the transparent layer in accordance with the number of scan of the first liquid discharger.

20 Claims, 7 Drawing Sheets

(56) References Cited

U.S. PATENT DOCUMENTS

2015/0306891 A1 10/2015 Sohgawa et al.

FOREIGN PATENT DOCUMENTS

| | | | |
|---|---|---|---|
| JP | 2012-056088 | A | 3/2012 |
| JP | 2013-159005 | A | 8/2013 |
| WO | WO-2010/109973 | A1 | 9/2010 |

* cited by examiner

FIG. 5A
| | | | | | | | |
|---|---|---|---|---|---|---|---|
| 1 | 4 | 1 | 4 | 1 | 4 | 1 | 4 |
| 3 | 2 | 3 | 2 | 3 | 2 | 3 | 2 |
| 1 | 4 | 1 | 4 | 1 | 4 | 1 | 4 |
| 3 | 2 | 3 | 2 | 3 | 2 | 3 | 2 |
| 1 | 4 | 1 | 4 | 1 | 4 | 1 | 4 |
| 3 | 2 | 3 | 2 | 3 | 2 | 3 | 2 |
| 1 | 4 | 1 | 4 | 1 | 4 | 1 | 4 |
| 3 | 2 | 3 | 2 | 3 | 2 | 3 | 2 |
4-PASS PRINTING
FIG. 5B
| | | | | | | | |
|---|---|---|---|---|---|---|---|
| 1 | 4 | 1 | 4 | 1 | 4 | 1 | 4 |
| 5 | 7 | 5 | 7 | 5 | 7 | 5 | 7 |
| 2 | 4 | 2 | 4 | 2 | 4 | 2 | 4 |
| 6 | 8 | 6 | 8 | 6 | 8 | 6 | 8 |
| 1 | 4 | 1 | 4 | 1 | 4 | 1 | 4 |
| 5 | 7 | 5 | 7 | 5 | 7 | 5 | 7 |
| 2 | 4 | 2 | 4 | 2 | 4 | 2 | 4 |
| 6 | 8 | 6 | 8 | 6 | 8 | 6 | 8 |
8-PASS PRINTING
FIG. 5C
| | | | | | | | |
|---|---|---|---|---|---|---|---|
| 1 | 13 | 4 | 16 | 1 | 13 | 4 | 16 |
| 9 | 5 | 12 | 8 | 9 | 5 | 12 | 8 |
| 3 | 15 | 2 | 14 | 3 | 15 | 2 | 14 |
| 11 | 7 | 10 | 6 | 11 | 7 | 10 | 6 |
| 1 | 13 | 4 | 16 | 1 | 13 | 4 | 16 |
| 9 | 5 | 12 | 8 | 9 | 5 | 12 | 8 |
| 3 | 15 | 2 | 14 | 3 | 15 | 2 | 14 |
| 11 | 7 | 10 | 6 | 11 | 7 | 10 | 6 |
16-PASS PRINTING
FIG. 6A
4-PASS PRINTING
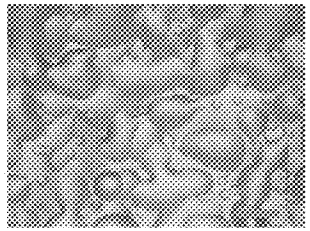
FIG. 6B
8-PASS PRINTING
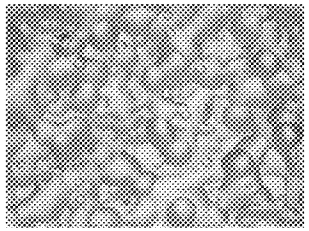
FIG. 6C
16-PASS PRINTING
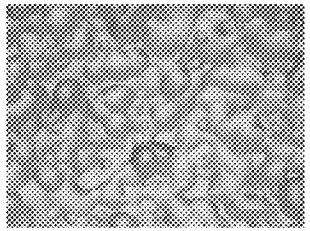

FIG. 7

| NUMBER OF PASS | CLEAR LAYER THICKNESS [μm] | EXAMPLE 1 | | | | | EXAMPLE 2 | | | | EXAMPLE 3 | | | EXAMPLE 4 | | |
|---|---|---|---|---|---|---|---|---|---|---|---|---|---|---|---|---|
| | | WITHOUT WHITE BACKGROUND | | | | | WITH WHITE BACKGROUND | | | | WITHOUT WHITE BACKGROUND | | | WITH WHITE BACKGROUND | | |
| | | W | K | C | M | Y | K | C | M | Y | R | G | B | R | G | B |
| 4 | 20 | △ | × | ○ | △ | × | × | ○ | △ | △ | × | × | △ | △ | △ | △ |
| 8 | 20 | △ | △ | ○ | ○ | △ | ○ | ○ | ○ | ○ | × | × | △ | ○ | ○ | ○ |
| 16 | 20 | △ | △ | ○ | ○ | △ | ○ | ○ | ○ | ○ | △ | △ | ○ | ○ | ○ | ○ |
| 4 | 40 | ○ | × | ○ | ○ | △ | △ | ○ | ○ | ○ | × | × | ○ | ○ | ○ | ○ |
| 8 | 40 | ○ | △ | ○ | ○ | ○ | ○ | ○ | ○ | ○ | △ | △ | ○ | ○ | ○ | ○ |
| 16 | 40 | ○ | ○ | ○ | ○ | ○ | ○ | ○ | ○ | ○ | ○ | ○ | ○ | ○ | ○ | ○ |
| 4 | 60 | ○ | △ | ○ | ○ | ○ | ○ | ○ | ○ | ○ | △ | × | ○ | ○ | ○ | ○ |
| 8 | 60 | ○ | ○ | ○ | ○ | ○ | ○ | ○ | ○ | ○ | ○ | ○ | ○ | ○ | ○ | ○ |
| 16 | 60 | ○ | ○ | ○ | ○ | ○ | ○ | ○ | ○ | ○ | ○ | ○ | ○ | ○ | ○ | ○ |

FIG. 8

| | SINGLE-COLOR IMAGE (KCMY) | | | | | | SECONDARY-COLOR IMAGE | | | | | |
|---|---|---|---|---|---|---|---|---|---|---|---|---|
| | WITHOUT WHITE BACKGROUND | | | WITH WHITE BACKGROUND | | | WITHOUT WHITE BACKGROUND | | | WITH WHITE BACKGROUND | | |
| NUMBER OF PASS | 4 | 8 | 16 | 4 | 8 | 16 | 4 | 8 | 16 | 4 | 8 | 16 |
| REQUIRED LAYER THICKNESS FOR FLATTENING [um] | 80 | 60 | 40 | 40 | 20 | 20 | 80 | 60 | 40 | 40 | 20 | 20 |

PRINTER, PRINTING METHOD, AND NON-TRANSITORY RECORDING MEDIUM

CROSS-REFERENCE TO RELATED APPLICATIONS

This patent application is a continuation of U.S. patent application Ser. No. 14/938,514, filed on Nov. 11, 2015, which claims priority pursuant to 35 U.S.C. § 119(a) to Japanese Patent Application No. 2014-244100, filed on Dec. 2, 2014, in the Japan Patent Office, the entire disclosure of each of which is hereby incorporated by reference herein.

BACKGROUND

Technical Field

The present disclosure relates to a printer, a printing method, and a non-transitory recording medium.

Description of the Related Art

Printers which print an image with an active energy ray curable liquid (e.g., ultraviolet (UV) curable ink) are known. Some of these printers form a coat layer on a printed color image with a transparent liquid for the purpose of giving gloss to the image, improving the properties (e.g., light resistance) of a recording medium, or protecting the image.

SUMMARY

In accordance with some embodiments of the present invention, a printer is provided. The printer includes a first liquid discharger, a second liquid discharger, a curing unit, and a controller. The first liquid discharger discharges a colored liquid that is active energy ray curable. The second liquid discharger discharges a transparent liquid that is active energy ray curable. The curing unit emits an active energy ray. The controller causes the first liquid discharger to scan multiple times and discharge the colored liquid on a medium, causes the curing unit to cure the colored liquid on the medium after each scan of the first liquid discharger to print a colored image with the colored liquid on the medium, causes the second liquid discharger to discharge the transparent liquid on the colored image, causes the curing unit to cure the transparent liquid on the colored image to form a transparent layer on the colored image, and controls a thickness of the transparent layer in accordance with the number of scan of the first liquid discharger.

In accordance with some embodiments of the present invention, a printing method is provided. The method includes the steps of: causing a first liquid discharger to scan multiple times and discharge a colored liquid that is active ray curable on a medium; emitting an active energy ray to the colored liquid on the medium to cure the colored liquid after each scan of the first liquid discharger to print a colored image with the colored liquid on the medium; causing a second liquid discharger to discharge a transparent liquid that is active ray curable on the colored image; emitting an active ray to the transparent liquid to cure the transparent liquid to form a transparent layer on the colored image; and controlling a thickness of the transparent layer in accordance with the number of scan of the first liquid discharger.

In accordance with some embodiments of the present invention, a non-transitory recording medium is provided. The non-transitory recording medium stores a plurality of instructions which, when executed by one or more processors, cause the processors to perform the above printing method.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIGS. 5A to 5C are illustrations for explaining various examples of multi-pass printing in accordance with an embodiment of the present invention;

FIGS. 6A to 6C are illustrations showing surface conditions of images formed with a colored liquid while varying the number of pass in accordance with an embodiment of the present invention;

FIG. 7 is a table showing subjective evaluation results of surface roughness of clear layers according to Examples 1 to 4;

FIG. 8 is a table showing required thicknesses of the clear layers for flattening both single-color and secondary-color images.

Figure 1:
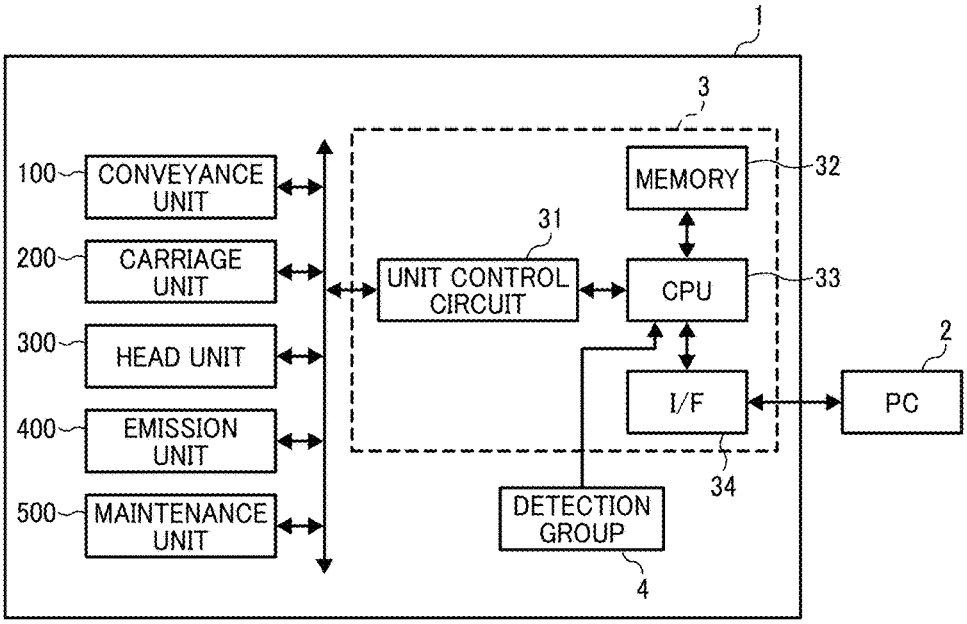
FIG. 1 is a block diagram illustrating the configuration of a printer in accordance with an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

When a printer equipped with a liquid discharger for discharging an active energy ray curable liquid performs multi-pass printing, in which the liquid discharger is caused to scan the same area multiple times to form an image, the surface roughness of the resulting image may vary depending on the number of scan (i.e., the number of pass) of the liquid discharger. For example, as the number of pass decreases, the surface roughness increases because the discharged liquid droplets are more likely to coalesce with adjacent liquid droplets.

Depending on the number of pass, there is a possibility that surface roughness cannot be leveled even if a coat layer is formed thereon.

In view of this situation, one object of the present invention is to provide a printer which forms a coat layer having both improved flatness and adhesion to an image regardless of the number of pass.

In accordance with some embodiments of the present invention, a printer which forms a coat layer having both improved flatness and adhesion to an image regardless of the number of pass is provided.

FIG. 1 is a block diagram illustrating the configuration of a printer in accordance with an embodiment of the present invention.

A printer 1 is a printer using a UV curable liquid as an active energy ray curable liquid.

The printer 1 is communicably connected to a computer (PC) 2 serving as an external controller. The computer 2 has a printer driver that converts image data into recording data (print data) that is printable with the printer 1 and transmits the print data to the printer 1. The recording data includes command data for operating a conveyance unit 100 of the printer 1 and pixel data relating to image. Each pixel of the pixel data may be composed of 2-bit data and expressed by four-level gradation.

The printer 1 includes the conveyance unit 100, a carriage unit 200, a head unit 300, an emission unit 400, a maintenance unit 500, a detection group 4, and a controller unit 3.

The controller unit 3 includes a central processing unit (CPU) 33, a memory 32, an interface (I/F) 34, and a unit control circuit 31. The memory 32 stores and holds a program in accordance with an embodiment of the present invention.

The controller unit 3 controls the conveyance unit 100, the carriage unit 200, the head unit 300, and the emission unit 400 to control a printing operation, based on the recording data received from the computer 2 and a detection signal received from the detection group 4. The program stored in the memory 32 causes the CPU 33 to execute a processing for controlling the print operation.

The controller unit 3 controls the maintenance unit 500 to perform maintenance on the head unit 300.

Figure 2:
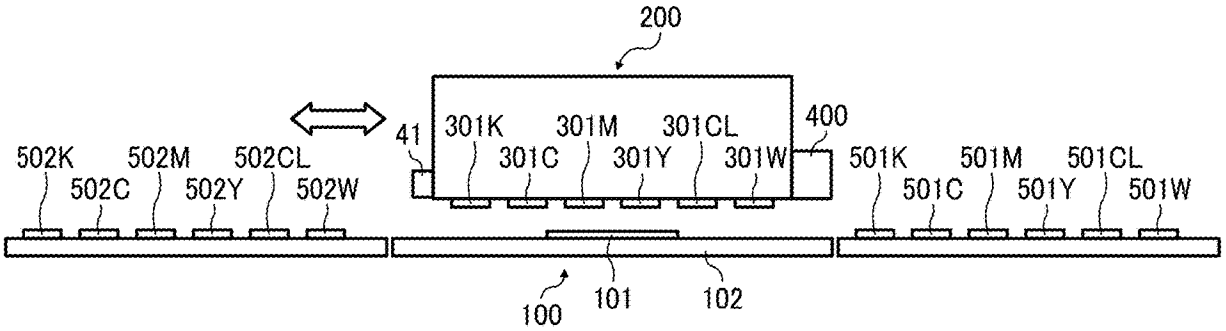
FIGS. 2 and 3 are side and plan views, respectively, of the mechanical section of the printer illustrated in FIG. 1.
Figure 3:
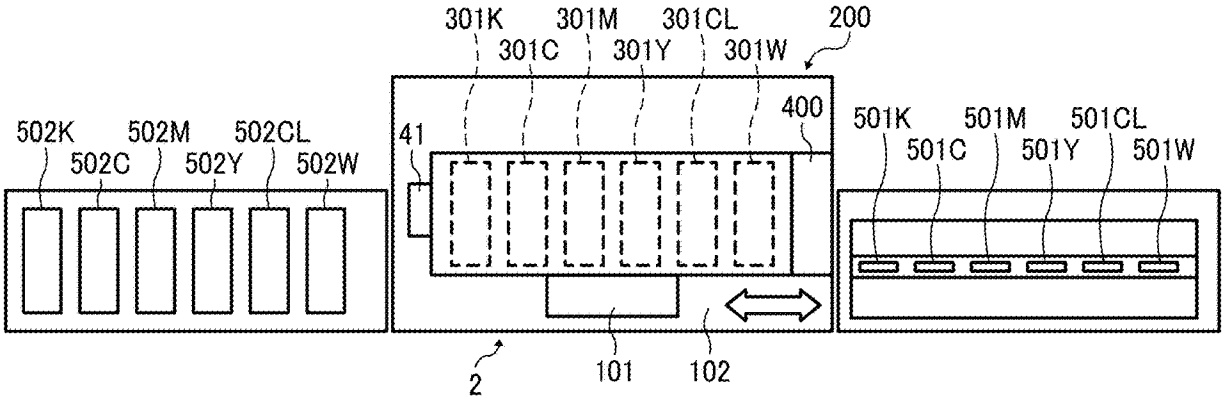

FIGS. 2 and 3 are side and plan views, respectively, of the mechanical section of the printer 1.

The conveyance unit 100 includes a conveyer 102 to fix a medium 101 thereon. The conveyer 102 has an adsorption mechanism to adsorptively fix the medium 101 thereon.

The carriage unit 200 is equipped with liquid discharge heads (hereinafter simply "heads") 301K, 301C, 301M, 301Y, 301CL, and 301W that compose the head unit 300 for discharging the UV curable liquid.

As the carriage unit 200 reciprocates in the direction indicated by arrows in FIGS. 2 and 3, the heads 301K, 301C, 301M, 301Y, 301CL, and 301W (hereinafter collectively "heads 301" in the case where they need not be distinguished) are caused to scan the medium 101.

The heads 301K, 301C, 301M, 301Y, and 301W each serve as a first liquid discharger to discharge a UV curable colored liquid of black (K), cyan (C), magenta (M), yellow (Y), and white (W), respectively. The head 301W also serves as a white liquid discharger. The color types of the colored liquids are not limited to the above-described colors.

The head 301CL serves as a second liquid discharger to discharge a UV curable transparent liquid (clear liquid).

The carriage unit 200 is also equipped with the emission unit 400 serving as a curing unit to emit ultraviolet light (UV light) as an active energy ray.

The carriage unit 200 is movable up and down relative to the plane of the conveyer 102, and is equipped with a height sensor 41. As the height sensor 41 measures the height of the carriage unit 200 above the medium 101, the controller unit 3 causes the carriage unit 200 to move up or down to come to a position where the distance between the head unit 300 and the medium 101 becomes a predetermined value.

On one side of the conveyance unit 100, caps 502K, 502C, 502M, 502Y, 502CL, and 502W (hereinafter collectively "caps 502" in the case where they need not be distinguished) are disposed. On the other side of the conveyance unit 100, wipers 501K, 501C, 501M, 501Y, 501CL, and 501W (hereinafter collectively "wipers 501" in the case where they need not be distinguished) are disposed. The caps 502 are for capping the discharge surfaces of the heads 301. The wipers 501 are for wiping and cleaning the discharge surfaces of the heads 301.

During the maintenance of the heads 301, a liquid is supplied to the heads 301 with pressure to be discharged from nozzles, and then the heads 301 are wiped and cleaned with the wipers 501. During the standby period, the heads 301 are capped with the caps 502 to maintain moisture retention condition.

The printing operation controlled by the controlling unit 3 is described below.

After the medium 101 is set on the conveyer 102 of the conveyance unit 100, the carriage unit 200 moves down to come to a predetermined height.

While reciprocating the carriage unit 200 to cause the heads 301 to scan, the heads 301K, 301C, 301M, 301Y, and 301W are caused to discharge a respective colored liquid. Thus, an image having a width corresponding to the width of the heads 301 (in a direction perpendicular to the scan direction) is formed.

The colored liquids discharged from the heads 301 on the medium 101 during the reciprocation motion of the carriage unit 200 are cured with UV light emitted from the emission unit 400.

After each scan, the conveyer 102 moves by a predetermined distance in a direction perpendicular to the scan direction and forms an image with the colored liquids on the medium 101.

At this time, the colored liquids discharged in the previous scan have been cured so as not to coalesce with the colored liquids discharged in an adjacent scan. Namely, the emission unit 400 emits UV light in an amount that the colored liquids are cured to the extent that coalescence of the colored liquids discharged in adjacent scans does not occur.

Next, the head 301CL is caused to discharge the transparent liquid (clear liquid) on the image formed with the colored liquids (hereinafter "colored image") on the medium 101. After applying the clear liquid on the entire surface of the required part of the colored image, the printer 1 is allowed to wait until the clear liquid becomes flat (i.e., until a leveling time elapses). After the leveling time elapses, the emission unit 400 emits UV light to cure the clear liquid to form a transparent layer (clear layer) serving as a coat layer.

In the printer 1, the controller unit 3 controls the printing operation.

In the printing operation, the carriage unit 200 is reciprocated to cause the heads 301K, 301C, 301M, 301Y, and 301W each serving as the first discharger to scan multiple times. The heads 301K, 301C, 301M, 301Y, and 301W are also caused to discharge respective colored liquids of black, cyan, magenta, yellow, and white on the medium 101. After each scan, the emission unit 400 serving as the curing unit is caused to cure the colored liquids on the medium 101 to form a colored image with the colored liquids on the medium 101.

Thereafter, the head 301CL serving as the second liquid discharger is caused to discharge the transparent liquid on the colored image, and then the emission unit 400 serving as the curing unit is caused to cure the transparent liquid to form a transparent layer on the colored image.

Such an printing operation provides a printing method including the steps of: reciprocating the carriage unit 200 to cause the heads 301K, 301C, 301M, 301Y, and 301W each serving as a first liquid discharger to scan multiple times and discharge respective colored liquids of black, cyan, magenta, yellow, and white on a medium 101; and causing the emission unit 400 serving as the curing unit to cure the colored liquids on the medium 101 to form a colored image with the colored liquids on the medium 101.

The printing method further includes the step of: causing the head 301CL serving as the second liquid discharger to discharge a transparent liquid on the colored image; and causing the emission unit 400 serving as the curing unit to cure the transparent liquid to form a transparent layer on the colored image.

The printer 1 contains a program to cause the computer 2, equipped for controlling the printer 1, to perform a processing for controlling the printing operation. The processing for controlling the printing operation includes the processes of: reciprocating the carriage unit 200 to cause the heads 301K, 301C, 301M, 301Y, and 301W each serving as a first liquid discharger to scan multiple times and discharge respective colored liquids of black, cyan, magenta, yellow, and white on a medium 101; causing the emission unit 400 serving as the curing unit to cure the colored liquids on the medium 101 to form a colored image with the colored liquids on the medium 101; causing the head 301CL serving as the second liquid discharger to discharge a transparent liquid on the colored image; and causing the emission unit 400 serving as the curing unit to cure the transparent liquid to form a transparent layer on the colored image.

Figure 4:
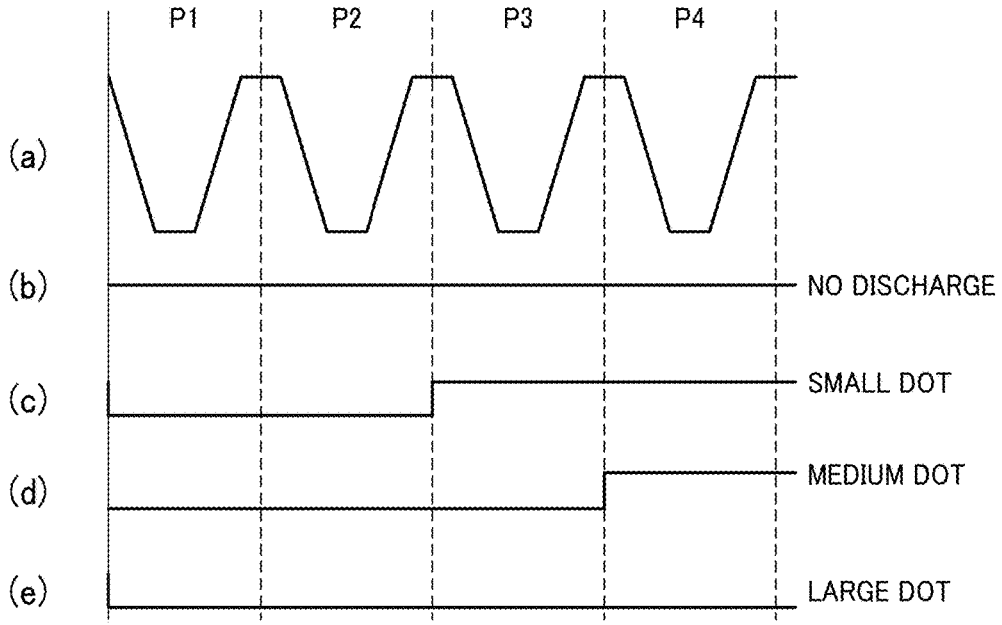
FIG. 4 is an illustration for explaining a discharge amount control for a liquid discharge head in accordance with an embodiment of the present invention.

A discharge amount control for the liquid discharge head is described below with reference to FIG. 4. FIG. 4 is a graph showing a driving signal for driving the liquid discharge head and selection signals for selecting driving pulses included in the driving signal.

In the present embodiment, each of the heads 301 employs a piezoelectric actuator as a pressure generator.

Referring to FIG. 4, a driving signal (a) is generated and output. The driving signal (a) includes driving pulses P1 to P4 within one driving cycle (one printing cycle). As selection signals (b) to (e) (masking signals: selected when ON) are applied in accordance with the size of dots to be formed, liquid droplets having a predetermined size are discharged.

When the selection signal (b) is applied, none of the driving pulses P1 to P4 is selected, and no liquid is discharged from the heads 301.

When the selection signal (c) is applied, the driving pulses P1 and P2 are selected, and small liquid droplets for forming small dots are discharged. Liquid droplets discharged by the driving pulses P1 and P3 coalesces each other while flying and impacts on a medium. (The same applies hereafter.)

When the selection signal (d) is applied, the driving pulses P1 to P3 are selected, and medium liquid droplets for forming medium dots are discharged.

When the selection signal (e) is applied, the driving pulses P1 to P4 are selected, and large liquid droplets for forming large dots are discharged.

Thus, the selection signal is selected based on pixel gradation, thus determining the discharge amount.

Multi-pass printing is described below with reference to FIG. 5. FIGS. 5A to 5C are illustrations for explaining various examples of multi-pass printing.

FIG. 5A is an illustration showing a dot arrangement order in 4-pass printing (i.e., high speed mode). In the 4-pass printing, an image is divided into 2×2 regions, and each of the regions is filled by four times of pass (scan).

FIG. 5B is an illustration showing a dot arrangement order in 8-pass printing (i.e., normal mode). In the 8-pass printing, an image is divided into 2×4 regions, and each of the regions is filled by 8 times of pass (scan).

FIG. 5C is an illustration showing a dot arrangement order in 16-pass printing (i.e., high image quality mode). In the 16-pass printing, an image is divided into 4×4 regions, and each of the regions is filled by 16 times of pass (scan).

In FIGS. 5A to 5C, the circled numbers each represent the order of liquid droplet impact in each scan of the carriage unit 200. The smaller number of scan is more likely to cause coalescence of liquid droplets since the same numbers come closer to each other.

FIGS. 6A to 6C are illustrations showing surface conditions of images formed with a yellow liquid while varying the number of pass.

As the number of pass increases, coalescence of dots becomes less likely to occur. As coalescence of dots becomes less likely to occur, the surface of the color image can be flattened depending on the number of pass.

FIG. 7 is a table showing subjective evaluation results of surface roughness of clear layers having various thicknesses, where the clear layers are formed on respective colored images formed with colored liquids while varying the number of pass by discharging and curing a clear liquid on each of the colored images.

In Example 1, a colored image is formed with one colored liquid without a white background image being formed with a white liquid, and a clear layer (transparent liquid layer) is formed on the colored image.

In Example 2, a colored image is formed with one colored liquid on a white background image formed with a white liquid, and a clear layer (transparent liquid layer) is formed on the colored image.

In Example 3, a colored image is formed with multiple colored liquids that form secondary colors (red, green, blue) without a white background image being formed with a white liquid, and a clear layer (transparent liquid layer) is formed on the colored image.

In Example 4, a colored image is formed with multiple colored liquids that form secondary colors (red, green, blue) on a white background image formed with a white liquid, and a clear layer (transparent liquid layer) is formed on the colored image.

In the table, "○" indicates that the clear layer is completely flattened, "Δ" indicates that the clear layer seemingly has no large problem but actually has rough surface, and "x" indicates that the surface roughness of the colored image has not been leveled at all.

These results lead to the following conclusion.

In the 16-pass printing, all the clear layers having a thickness of 40 μm or more are flattened. In the 8-pass printing, all the clear layers having a thickness of 60 μm or more are flattened. In the 4-pass printing, each of the clear layers is required to have a thickness of 60 μm or more to be flattened.

As the number of pass increases, the thickness of the clear layer required for flattening decreases (i.e., the clear layer becomes thinner). The greater number of pass reduces the thickness of the clear layer, thereby improving the adhesion between the medium and the colored image.

Comparison of Example 1 with Example 2 and comparison of Example 3 with Example 4 each indicate that, when the colored image is formed on the white background image, the clear layers having a thickness of 60 μm are all flattened in all the 4-pass, 8-pass, and 16-pass printings. In the 8-pass and 16-pass printings, the clear layers having a thickness of 20 μm are flattened.

Thus, forming the colored image on the white background image reduces the surface roughness of the colored image, thereby reducing the amount of the clear liquid used for flattening.

In other words, it is possible that the first liquid discharger includes a white liquid discharger (head 301W) to discharge a white liquid, and the thickness of the transparent layer formed on the colored image which is printed on a white image printed with the white liquid is smaller than that formed on the colored image which is printed without the white image being printed.

Thus, the amount of the clear liquid used for flattening can be reduced.

Comparison of Example 1 with Example 3 indicates that the surface roughness is less likely to be leveled in Example 3 compared to Example 1. This is because the liquid droplets more probably coalesce with each other in forming the secondary colors, thereby increasing the surface roughness. To level such a large surface roughness of the secondary color, the amount of the clear liquid to be used should be increased.

In other words, it is possible that the first liquid discharger includes a plurality of colored liquid dischargers to discharge a plurality of colored liquids, and the thickness of the transparent layer formed on the colored image which is printed with one of the plurality of colored liquids is smaller than that formed on the colored image which is printed with the plurality of colored liquids.

Thus, the amount of the clear liquid used in printing the colored image with one colored liquid can be reduced.

FIG. 8 is a table showing required thicknesses of the clear layers for flattening both single-color and secondary-color images. If the coating is not rigorous, a required thickness for flattening single-color image and that for secondary-color image may be equal.

Figure 9:
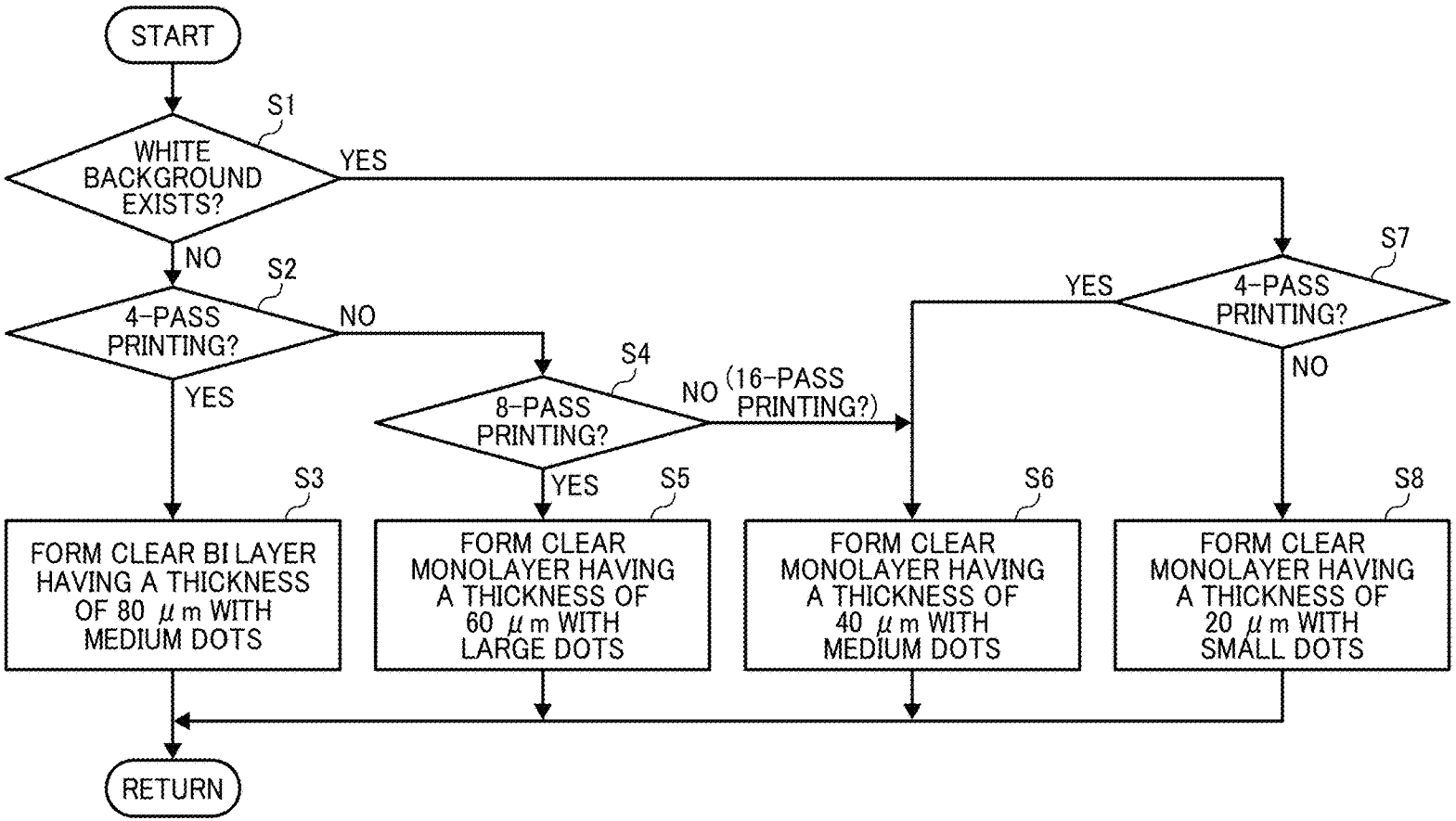
FIG. 9 is a flowchart illustrating a processing for determining the clear liquid discharge condition (clear layer thickness) for forming the clear layer coating.

FIG. 9 is a flowchart illustrating a processing for determining the clear liquid discharge condition (clear layer thickness) for forming the clear layer coating.

The memory 32 of the controller unit 3 stores and holds a table containing the relationship between the existence or non-existence state of the process of printing a white background image with a white liquid (hereinafter "white background process" for convenience), and the number of pass in printing a colored image with colored liquids.

In step S1, whether the white background process exists or not is determined.

When it is determined in S1 that the white background process does not exist, in step S2, whether the colored image is formed by 4-pass printing or not is determined.

When it is determined in step S2 that the colored image is formed by 4-pass printing, in step S3, the discharge condition is determined so that the clear liquid is discharged in the form of medium droplets to form a clear bilayer having a thickness of 80 μm with medium dots.

When it is determined in step S2 that the colored image is not formed by 4-pass printing, in step S4, whether the colored image is formed by 8-pass printing or not is determined.

When it is determined in step S4 that the colored image is formed by 8-pass printing, in step S5, the discharge condition is determined so that the clear liquid is discharged in the form of large droplets to form a clear monolayer having a thickness of 60 μm with large dots.

When it is determined in step S4 that the colored image is not formed by 8-pass printing, in other words, the colored image is formed by 16-pass printing, in step S6, the discharge condition is determined so that the clear liquid is discharged in the form of medium droplets to form a clear monolayer having a thickness of 40 μm with medium dots.

When it is determined in S1 that the white background process exists, in step S7, whether the colored image is formed by 4-pass printing or not is determined.

When it is determined in step S7 that the colored image is formed by 4-pass printing, in step S6, the discharge condition is determined so that the clear liquid is discharged in the form of medium droplets to form a clear monolayer having a thickness of 40 μm with medium dots.

When it is determined in step S7 that the colored image is not formed by 4-pass printing, in step S8, the discharge condition is determined so that the clear liquid is discharged in the form of small droplets to form a clear monolayer having a thickness of 20 μm with small dots.

Thus, the printing operation includes a processing of controlling the thickness of the transparent layer according to the number of scan (i.e., the number of pass in the case of multi-printing) of the heads 301K, 301C, 301M, 301Y, and 301W each serving as the first liquid discharger in printing the colored image with colored liquids.

Accordingly, the coat layer (or transparent layer or clear layer) can secure both flatness and adhesion to an image.

The active energy ray curable liquid is not limited to the UV curable liquid. Specific examples of the active energy ray curable liquid include, for example, electron beam (EB) curable liquid.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. A liquid discharge apparatus comprising:

a first liquid discharge head configured to discharge a white liquid onto an object to form a white layer;

a second liquid discharge head configured to discharge a colored liquid onto the object or the white layer to form a colored layer;

a third liquid discharge head configured to discharge a transparent liquid onto the colored layer to form a transparent layer; and a controller configured to control thickness of the transparent layer based on whether the white layer exists or not.

2. The liquid discharge apparatus of claim 1, wherein the white liquid, the colored liquid, and the transparent liquid are active energy ray curable liquids.

3. The liquid discharge apparatus of claim 2, further comprising:

a curing unit configured to emit an active energy ray on the white liquid, the colored liquid, and the transparent liquid.

4. The liquid discharge apparatus of claim 3, wherein the controller is further configured to:

instruct the first liquid discharge head to discharge the white liquid, and instruct the curing unit to cure the white liquid discharged by the first liquid discharged head to form the white layer;

instruct the second liquid discharge head to discharge the colored liquid onto the white layer, and instruct the curing unit to cure the colored liquid discharged by the second liquid discharged head to form the colored layer; and instruct the third liquid discharge head to discharge the transparent liquid onto the colored layer, and instruct the curing unit to cure the transparent liquid discharged by the third liquid discharge head to form the transparent layer.

5. The liquid discharge apparatus of claim 2, wherein the active energy ray curable liquids are ultraviolet curable liquids.

6. The liquid discharge apparatus of claim 2, wherein the active energy ray curable liquids are electron beam curable liquids.

7. The liquid discharge apparatus of claim 1, wherein the controller is further configured to control the thickness of the transparent layer to be thicker when the white layer does not exist on an area of the object where the transparent liquid is being discharged than when the white layer exists on an area of the object where the transparent liquid is being discharged.

8. The liquid discharge apparatus of claim 1, wherein the controller is further configured to control the thickness of the transparent layer by changing a size of droplets of the transparent liquid discharged from the third liquid discharge head.

9. The liquid discharge apparatus of claim 1, wherein the controller is further configured to control the thickness of the transparent layer by changing a number of layers formed with the transparent liquid discharged from the third liquid discharge head.

10. A method of operating a liquid discharge apparatus comprising:

discharging, using at least one controller, a white liquid onto an object to form a white layer using a first liquid discharge head;

discharging, using the at least one controller, a colored liquid onto the object or the white layer to form a colored layer using a second liquid discharge head;

discharging, using the at least one controller, a transparent liquid onto the colored layer to form a transparent layer using a third liquid discharge head; and controlling, using the at least one controller, thickness of the transparent layer based on whether the white layer exists or not.

11. The method of claim 10, wherein the white liquid, the colored liquid, and the transparent liquid are active energy ray curable liquids.

12. The method of claim 11, further comprising:

emitting, using the at least one controller, an active energy ray on the white liquid, the colored liquid, and the transparent liquid using a curing unit.

13. The method of claim 12, further comprising:

forming the white layer by discharging the white liquid using the first liquid discharge head and curing the discharged white liquid using the curing unit to form the white layer;

forming the colored layer by discharging the colored liquid onto the white layer using the second liquid discharge head and curing the discharged colored liquid using the curing unit to form the colored layer; and forming the transparent layer by discharging the transparent liquid onto the colored layer using the third liquid discharge head and curing the discharged transparent liquid using the curing unit to form the transparent layer.

14. The method of claim 11, wherein the active energy ray curable liquids are ultraviolet curable liquids.

15. The method of claim 11, wherein the active energy ray curable liquids are electron beam curable liquids.

16. The method of claim 10, wherein the controlling the thickness of the transparent layer includes controlling the thickness of the transparent layer to be thicker when the white layer does not exist on an area of the object where the transparent liquid is being discharged than when the white layer exists on an area of the object where the transparent liquid is being discharged.

17. The method of claim 10, wherein the controlling the thickness of the transparent layer includes changing a size of droplets of the transparent liquid discharged from the third liquid discharge head.

18. The method of claim 10, wherein the controlling the thickness of the transparent layer includes changing a number of layers formed with the transparent liquid discharged from the third liquid discharge head.

19. A non-transitory computer readable medium including computer readable instructions, which when executed by at least one processor, causes the at least one processor to:

discharge a white liquid onto an object to form a white layer using a first liquid discharge head;

discharge a colored liquid onto the object or the white layer to form a colored layer using a second liquid discharge head;

discharge a transparent liquid onto the colored layer to form a transparent layer using a third liquid discharge head; and control thickness of the transparent layer based on whether the white layer exists or not.

20. The non-transitory computer readable medium of claim 19, wherein the white liquid, the colored liquid, and the transparent liquid are active energy ray curable liquids.

* * * * *